US005740632A

United States Patent [19]

Peterson et al.

[11] Patent Number: 5,740,632

[45] Date of Patent: Apr. 21, 1998

[54] MULTI-POSITION WINDOW OPERATOR HANDLE

[75] Inventors: Steven G. Peterson, Hudson, Wis.; Craig R. Orf, Oakdale, Minn.; Rodney R. Lake, Machesney Park, Ill.

[73] Assignee: Andersen Corporation, Bayport, Minn.

[21] Appl. No.: 648,339

[22] Filed: May 15, 1996

Related U.S. Application Data

[63] Continuation-in-part of Ser. No. 443,473, May 18, 1995, abandoned.

[51] Int. Cl.[6] ..... E05B 1/00

[52] U.S. Cl. ..... 49/460

[58] Field of Search ..... 49/460; 74/527, 74/547, 528, 545, 546, 548, 557; 16/DIG. 24

[56] References Cited

U.S. PATENT DOCUMENTS

| | | | |
|---|---|---|---|
| D. 330,839 | 11/1992 | Barrington et al. | D8/315 |
| 331,531 | 12/1885 | Neracher . | |
| 343,691 | 6/1886 | Baulieu . | |
| 588,403 | 8/1897 | Davidson | 74/546 |
| 1,191,855 | 7/1916 | Tuszka | 74/547 |
| 1,406,973 | 2/1922 | Carter | 74/547 |
| 1,517,913 | 12/1924 | Lenahan | 49/460 |
| 1,595,277 | 8/1926 | Wittel | 74/547 |
| 2,165,060 | 7/1939 | Krug | 74/547 |
| 3,159,048 | 12/1964 | Clifford | 74/547 |
| 3,375,993 | 4/1968 | Hayes | 74/546 |
| 3,606,193 | 9/1971 | Allred | 74/546 |
| 4,155,517 | 5/1979 | Sazaki | 74/547 |
| 4,466,658 | 8/1984 | Furst et al. | 74/547 |
| 4,928,547 | 5/1990 | Huyer | 74/547 |
| 5,097,629 | 3/1992 | Guhl et al. | 49/386 |
| 5,168,770 | 12/1992 | Ellis | 74/547 |
| 5,201,241 | 4/1993 | Pollack, Jr. | 74/528 |
| 5,205,074 | 4/1993 | Guhl et al. | 49/386 |
| 5,368,249 | 11/1994 | Takeuchi | 74/547 |

*Primary Examiner*—Blair Johnson
*Assistant Examiner*—Curtis Cohen
*Attorney, Agent, or Firm*—Merchant, Gould, Smith, Edell, Welter & Schmidt, P.A.

[57] ABSTRACT

A window operator for rotating drive members which extend out a window sash. The operator handle has at least two positions, one position being extended in an operable position and the other position being a folded, non-operable position.

5 Claims, 6 Drawing Sheets

FIG. 9
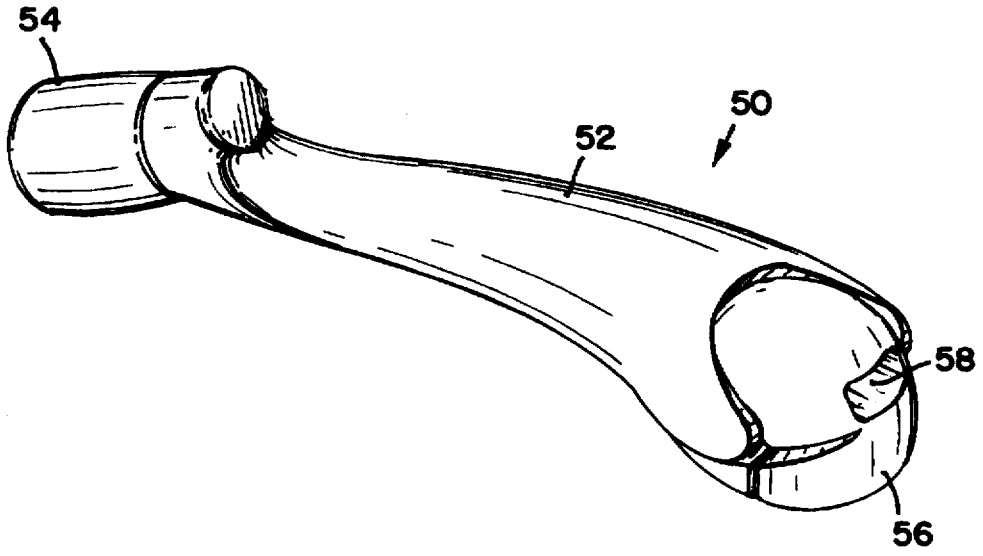
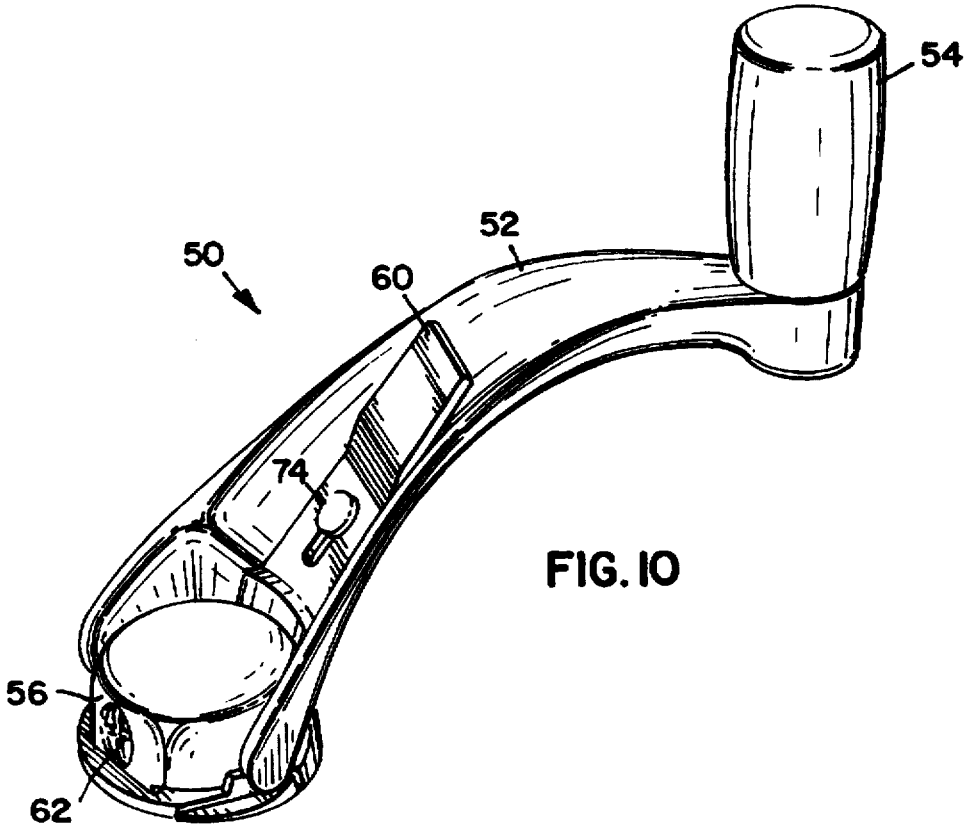
FIG. 10

MULTI-POSITION WINDOW OPERATOR HANDLE

This is a Continuation-in-Part of U.S. patent application Ser. No. 08/443,473, filed May 18, 1995 now abandoned.

FIELD OF THE INVENTION

The present invention relates to an improved window operator handle which has at least two positions, with one position extending outwardly in an operable position and a second position which results in the handle folded inwardly, in a non-operable position.

BACKGROUND OF THE INVENTION

Casement, awning and roof windows are examples of operable windows which, when opened and closed, move in a plane away from the structure in which the window is contained. The movement of these types of windows results from the operation of window hardware which is generally secured to the frame and sash of the window. The frame of the window is that portion of the window which is secured to the structure or dwelling in which the window sits. The sash of the window, comprised of stiles (the vertical members) and rails (the horizontal members), contains the glazing or glass. The operable sash is mechanically secured to the frame. The window hardware accomplishes this mechanical securing.

There are a many types of window hardware, as shown in U.S. Pat. Nos. 5,097,629, 5,205,074, 343,691, and 331,531. For the purposes of the present invention, the window hardware which the present invention addresses includes an operator handle, which when rotated opens and closes the sash of the window.

Previously, the window operator handle extends in an outwardly direction, which when rotated, rotates gears which sets the window sash in motion. This is generally accomplished through the cooperation of gears and linkable arms which are secured to the sash and to the hardware which is secured to the frame. Shortcomings encountered with the prior art handles is the handle extends outwardly, into the room in which the window is situated. This could create a hazard, in that upon walking by the window, moving furniture, closing curtains, etc., one could bump into the handle, which could either break the handle, injure the individual who bumped into the handle, or damage furniture or other items which may brush up against the handle. This was alleviated in the prior art using a removable handle, wherein a set screw could be rotated, which allowed the user to take off the handle. However, this was cumbersome and not very convenient to take off the handle and put it back on when it was necessary to operate the sash of the window and a safety hazard.

Another disadvantage of the prior art window operator handles is that aesthetically, low profile window hardware is preferred. Window hardware often detracts from the appearance of the window, and large bulky window hardware may even hinder the view out of the window. Thus, it is desirable to have as low profile of window hardware as possible.

The present invention provides numerous advantages for window hardware, and addresses the problems of prior operator handles. These and other advantages will be explained herein.

SUMMARY OF THE INVENTION

The present invention provides a low profile window operator handle which has at least two positions, with one position extending outwardly and the second position folded inwardly. The window operator has a handle, with the handle comprising a housing and an arm pivotally attached to the housing. The handle comprises three components, with the first component being an arm pivotally attached to the housing, and a second component being a knob, which is rotatably secured to the arm. The third component is the pivot axis about which the arm pivots. The arm has at least two positions, with a first position extending outwardly from a plane defined by a horizontal surface to which the housing is mounted, and a second position whereby the arm pivots about the housing, and extends in approximately a horizontal position with the plane.

The window handle is preferably mechanically configured such that the two positions are locking positions, which are accomplished through the use of detents, springs, clips, etc.

BRIEF DESCRIPTION OF THE DRAWINGS

FIG. 9 is a perspective view of an alternative embodiment of the present invention in a non-operational mode.

FIG. 10 is a perspective view of an alternative embodiment of the present invention in an operational mode.

DETAILED DESCRIPTION OF THE EMBODIMENT

The present invention is directed to an improved window operator handle. The instant invention has numerous advantageous features over those found in the prior art. A critical feature of the present invention is the ability of the handle to be closed or folded, such that the window operator does not extend intrusively into the internal environment. This is demonstrated in the attached figures.

Figure 1:
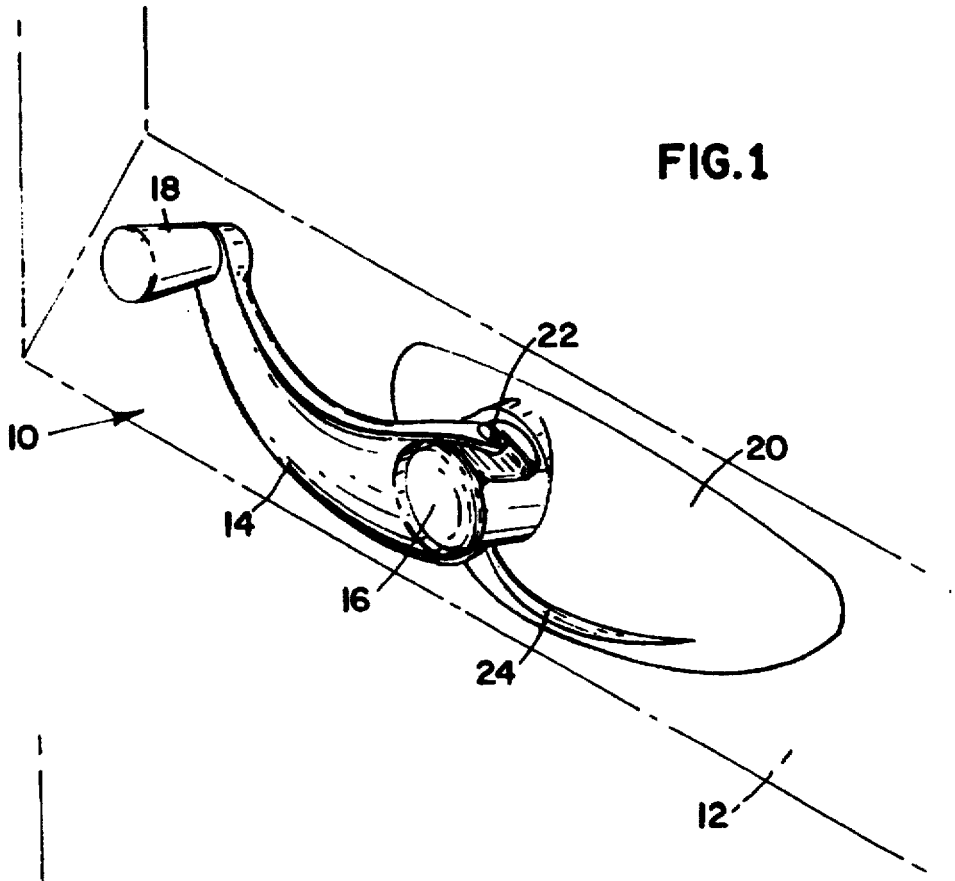
FIG. 1 is a perspective view of the window operator of the present invention in an operable mode.
Figure 2:
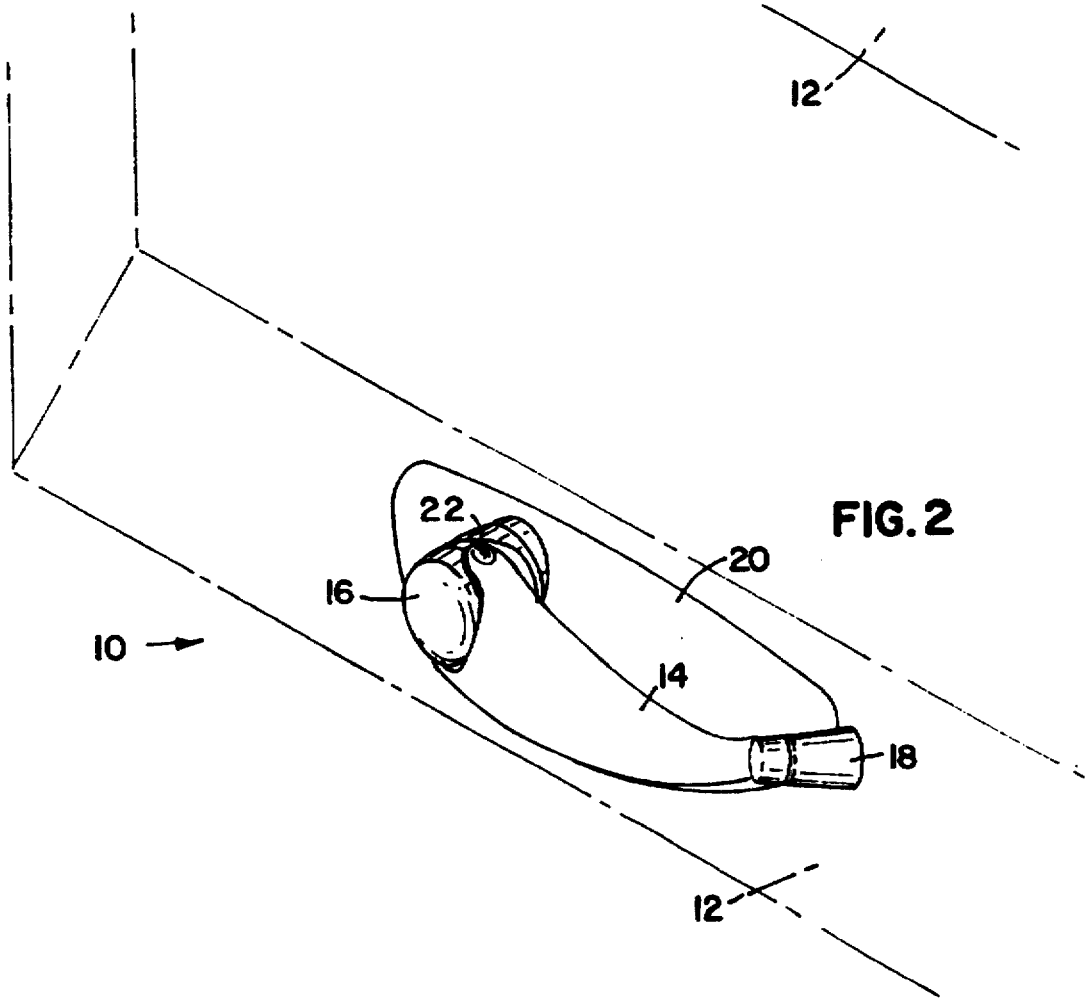
FIG. 2 is a window operator of the present invention in a non-operable mode.
Figure 3:
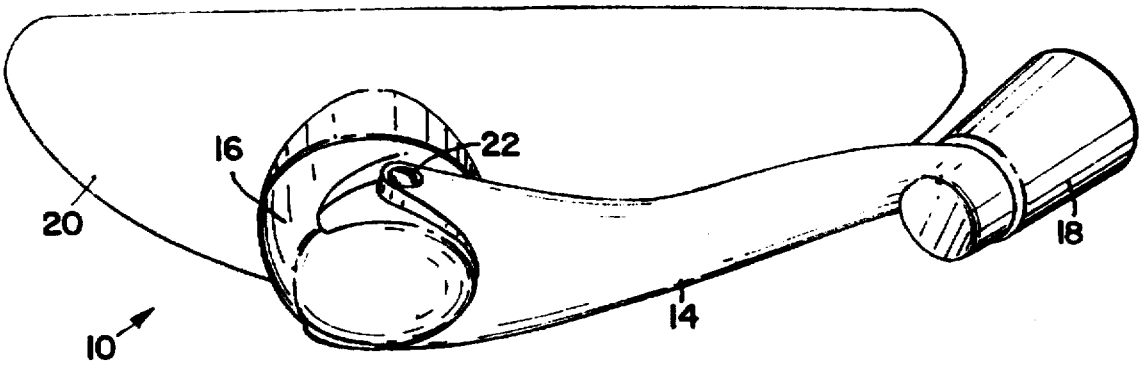
FIG. 3 is a top view of the window operator of the present invention is a non-operable mode.
Figure 4:
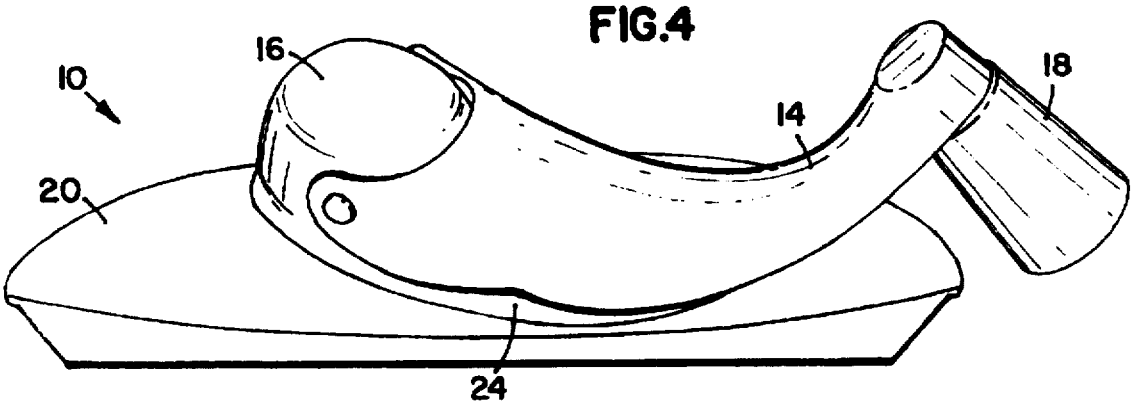
FIG. 4 is a view projected from the bottom of the window operator of the present invention in a non-operable mode.

FIG. 1 shows the present invention as 10. The invention is mounted to a frame of a window with just a portion of the frame being shown as 12. The operator handle may be secured to a bottom or side frame member, or in the event of a roof window or other type of window, may not be secured to the frame at all. The invention 10 has arm 14 secured to a housing 16 and a knob 18 which is rotatably secured to arm 14. An operator cover 20 hides the gear mechanisms and routing in the frame which must occur to secure the hardware to the frame. The pivot axis 22, although not readily visible in FIG. 1, is more apparent in FIGS. 3, 4, 7 and 8. This pivot axis 22 is a point about which arm 14 rotates from an open position as shown in FIG. 1 to the closed position as shown in FIG. 2. The pivot axis is an extension of the arm 14 or a separate pin, screw or other type of securing means which allows arm 14 to pivot or rotate. Preferably, the pivot axis is a pair of prongs which project from arm 14, and extend inwardly (shown in FIG. 7). Housing 16 has slots which allow the housing 16 to be placed over the inward facing prongs. The housing 16 is thereafter secured to operator cover 20 through any generally known fastening systems such as screws, welds, etc. The prongs thereafter act as the pivot axis.

Preferably, the operator cover 20 also has handle rest 24. This handle rest 24 is a raised projection from operator cover 20. The projection 24 provides a rest for arm 14 when it is in its non-operable mode. This is most visible in FIG. 4, wherein 24 is clearly identified. The purpose of projection 24 is to keep the arm 14 from dropping below the window frame. From an aesthetic point of view, it is undesirable to have the window operator handle drape below the window frame or hang without some type of support.

Figure 5:
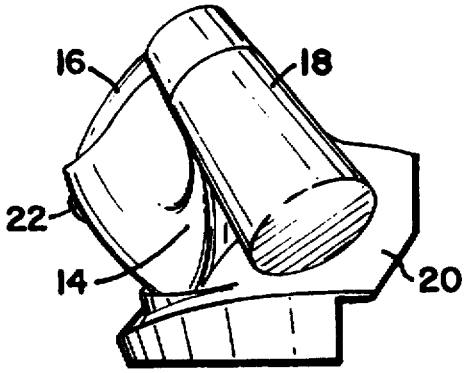
FIG. 5 is an end view of the figure of the present invention in a non-operable mode.
Figure 6:
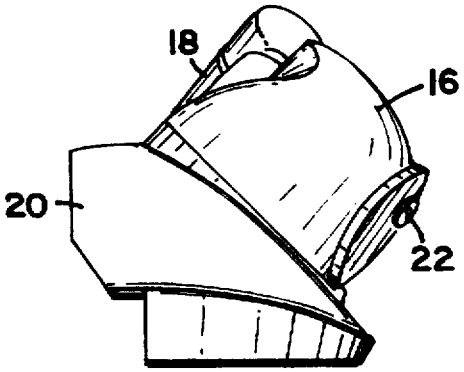
FIG. 6 is the opposite view of that shown in FIG. 5.

FIGS. 5 and 6 illustrate the handle in the folded position, and illustrates the low profile which results from the present invention.

The arm 14 has at least two locking positions. The first locking position, that being in an operable mode, is shown in FIG. 1. The arm 14 is extended outwardly, initially away from the window frame 12. In the preferred embodiment, arm 14 is curved such that knob 18 extends almost approximately perpendicular to the window, for ease of operation. When the arm 14 is not in use, arm 14 may be moved from the operable position to the non-operable position, as shown in FIG. 2. In the preferred mode, some mechanical detent located on the pivot axis 22 secures or "locks" the arm in each position. This locking assists the user in readily recognizing through a mechanical "click" the operable and non-operable position. The locking also secures the handle in the positions so it does not move or collapse. This two position locking is preferred such that the user can readily ascertain two positions and the arm locks in the two modes. Possibly, some kind of mechanical detent might be used only for the open position, wherein the closed position rests on some type of projection such as 24.

Figure 7:
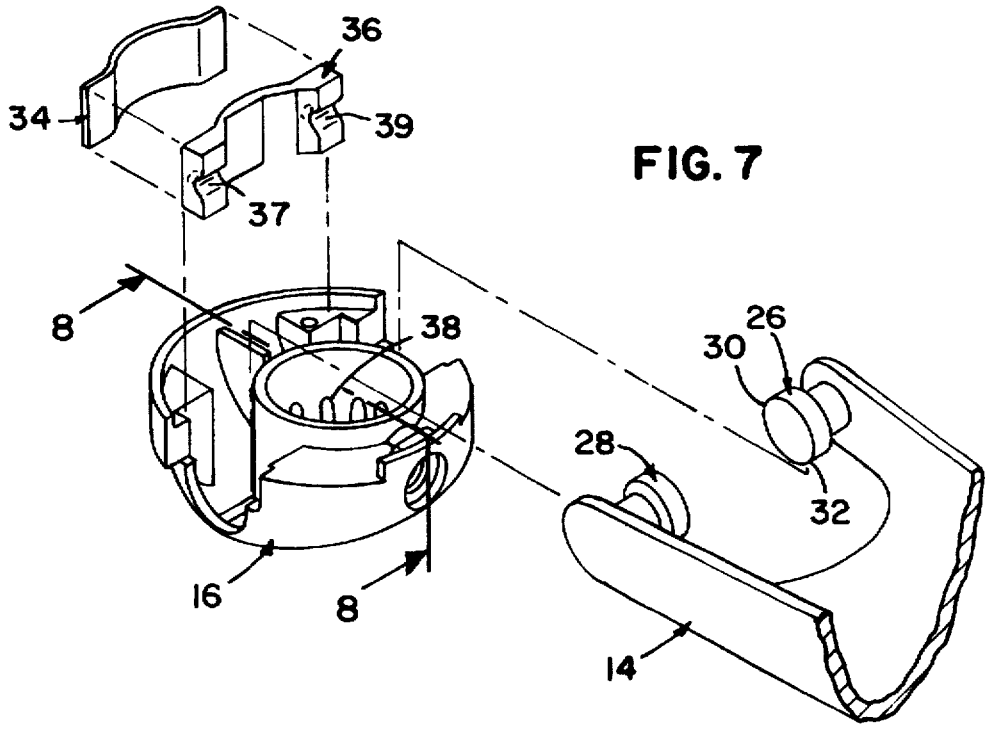
FIG. 7 is a schematic of the detent mechanism in the housing in an exploded view.
Figure 8:
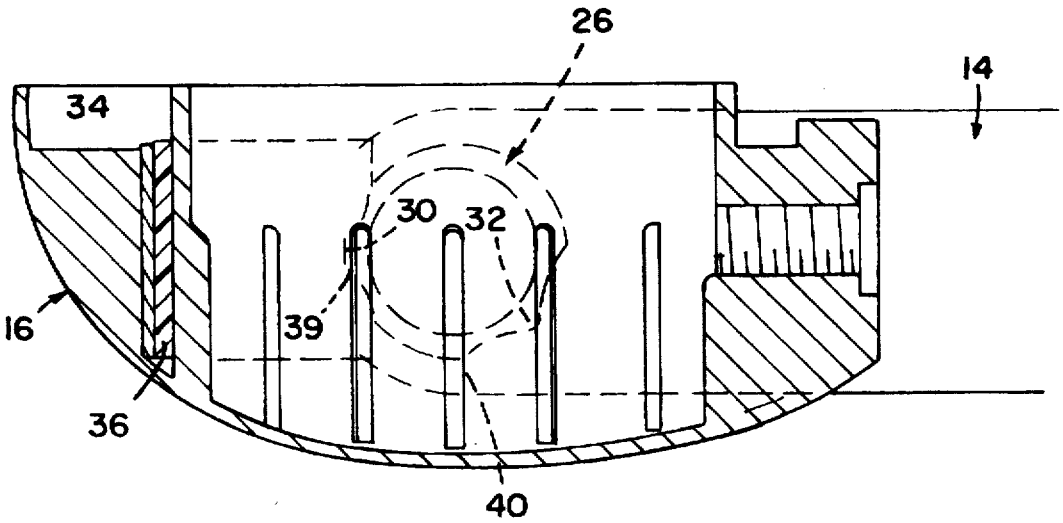
FIG. 8 is a close up cross-sectional view taken along lines 8 from FIG. 7 of the detent mechanism in the housing in a locking position.

FIGS. 7 and 8 show an exploded and close-up view of the preferred locking mechanism. The preferred type of mechanical "lock" for the arm 14 in its two positions is accomplished by the pivot axis, being prongs 26 and 28, with detents on the prongs (shown as 30 and 32 on prong 26), having an indentation on the exterior of the circumference of the prong 26. This is shown in FIGS. 7 and 8. The detents could be on one or both prongs 26 and 28. A spring (typically made of a resilient metal or plastic) 34 with a mating surface 36 for the detents 30 and 32 is shown. The spring 34 compresses mating surface 36 (which is preferably a stiff material such as a hard plastic) against prongs 26 and 28. (Mating surface 36 is optional and could be omitted leaving just spring 34. If mating surface 36 is omitted, detents would be placed on spring 34 such that detents 30 and 32 mate with the detents on spring 34). As the prongs 26 and 28 are rotated through movement of the arm 14, detents 30 and 32 approach the detents in mating surface 36, shown as 37 and 39. The edge of detent 30 or 32 (shown as the area designated by 40 in FIG. 8) "locks" into the detent 39 as shown in FIG. 8. The detents 30 and 32 are positioned such that the arm 14 locks in its open position as shown in FIG. 1 and the closed position shown in FIG. 2. The preferred detent mechanism is shown, but others could work as well.

FIG. 9 shows an alternative embodiment of the multi-position window operator handle described above. In this embodiment, the handle is shown in a non-operational mode. Referring to FIG. 9, the alternative embodiment 50 the operator handle has arm 52 and knob 54. The arm 52 is secured to a housing 56 which has an indentation 58 which is used to lock the arm 52 in the operational mode as described below.

FIG. 10 illustrates the operator handle 50 in an operational mode. This is the mode wherein the handle 50 is rotated in a clockwise or counterclockwise manner in order to open and close the window. FIG. 10 illustrates the use of locking clip 60 which engages in notch 58 to secure the arm 52 in an operational mode. Locking clip 60 is spring loaded (which is better shown in FIG. 11) and may be slid longitudinally. Prior to engaging indent 58, locking clip 60 is biased against the exterior hub 56. As arm 52 is swung from a closed position as shown in FIG. 9 to a operational position as shown in FIG. 10, locking clip 60 slides or rotates over hub cover 56 until it locks into place into indent 58. Thereafter, when the arm 52 is intended to be put in a closed, low profile position, locking clip 60 is pulled back by the operator's thumb in the direction of knob 54 thereby releasing arm 52 from indent 58 and the arm 52 is free to rotate back to the position shown in FIG. 9.

Figure 11:
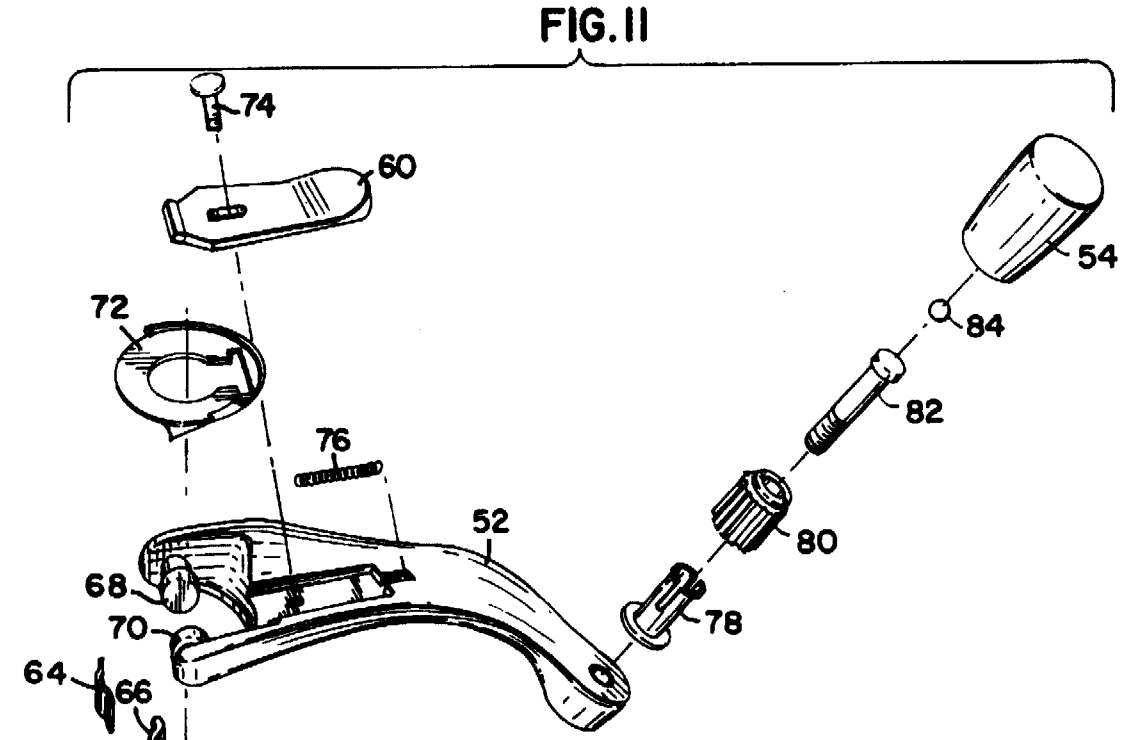
FIG. 11 is an exploded view of the alternative embodiment of FIG. 9.

FIG. 11 represents an exploded view of the operator shown in FIGS. 9 and 10. Beginning in the lower portion of FIG. 11, hub cover 56 is shown with retaining screw 62. Resistance spring 64 and bearing 66 operate as a bias against prongs 68 and 70. This is similar to the embodiment shown in FIGS. 1–8. The purpose of spring 64 and bearing 66 is to provide resistance during closing for arm 52. Any resistance means can be used in this fashion, with the preferred resistance means being springs or clips as shown in 64 and 66. Prongs 68 and 70 engage in hub 56 with sealing cover 72 and is staked in place to secure arm 52 into hub 56. To limit wear protective sleeve could be attached to prongs 68 and 70. The locking means 60 is shown with a guide pin 74 and spring 76. Knob 54 is secured to arm 52 by a series of bushings, gears and pins shown as 78, 80, 82, and 84.

Figure 12:
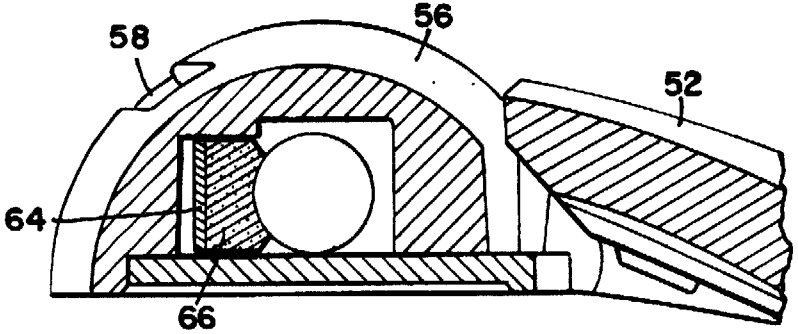
FIG. 12 is a cross-sectional view of the hub of the alternative embodiment shown in FIG. 9.

FIG. 12 is a cross-sectional view of hub 56.

It is to be understood, however, that even though numerous characteristics and advantages of the invention have been set forth in the foregoing description, together with details of the structure and function of the invention, the disclosure is illustrative only, and changes may be made in detail, especially in matters of shape, size and arrangement of parts within the principle of the invention, to the full extent indicated by the broad general meaning of the terms in which the appended claims are expressed.

We claim:

1. A window operator handle, said handle comprising:

(a) a housing having a generally planar bottom surface for mounting to a window frame having a generally planar mounting surface;

(b) an arm having a central longitudinal axis secured to said housing at a first end with a knob secured to a second end of said arm, said arm having a center point substantially equidistant from said first and second ends, (c) a pivot means pivotally attaching said arm to said housing, said arm having at least two positions, a first position which extends said knob outwardly from said housing bottom plane, and a second position which extends said knob inwardly toward said housing bottom surface plane whereby said arm is pivoted about said housing and in a plane and pivots through an obtuse angle;

(d) means for locking the arm in one of the first and second positions; and (e) said arm, is sufficiently curved such that when in the second position the longitudinal axis at said second end is further from said housing bottom surface plane than the longitudinal axis at said arm's center point whereby the knob extends inwardly and is adapted to still not extend into a mounting surface of a window frame.

2. The window operator of claim 1 wherein said housing comprises a raised projection which provides a rest for said handle when said arm is in said second position.

3. The window operator of claim 1 wherein said locking means comprises a detent which cooperates with said pivot means to lock said handle in at least one position.

4. The window operator of claim 1 wherein said locking means comprises a spring mechanism biased against at least one prong of said arm, with said prong having a detent mating surface with said spring mechanism which defines a locking position.

5. The window operator of claim 1 wherein said locking means comprises a clip on said arm, said clip being slidably engageable into an indent located on the exterior of said housing.

* * * * *